US006222565B1

(12) United States Patent
van Os

(10) Patent No.: US 6,222,565 B1
(45) Date of Patent: Apr. 24, 2001

(54) SCANNING DEVICE FOR SCANNING AN IMAGE CARRIER

(75) Inventor: Albertus M. B. M. van Os, Grathem (NL)

(73) Assignee: Oce-Technologies, B.V., Venlo (NL)

( * ) Notice: Subject to any disclaimer, the term of this patent is extended or adjusted under 35 U.S.C. 154(b) by 0 days.

(21) Appl. No.: 09/122,103

(22) Filed: Jul. 24, 1998

(30) Foreign Application Priority Data

Jul. 25, 1997 (NL) ..... 1006664

(51) Int. Cl.[7] ..... B41J 2/41
(52) U.S. Cl. ..... 347/112; 347/138; 347/257
(58) Field of Search ..... 347/112, 242, 347/252, 130, 238, 292, 295, 138, 152, 257, 263

(56) References Cited

U.S. PATENT DOCUMENTS 5,036,339 7/1991 Hediger ..... 547/242
5,543,829 * 8/1996 Fisli ..... 347/252
5,808,718 * 9/1998 Aikoh et al. ..... 347/242
5,841,463 * 11/1998 Debesis et al. ..... 347/242

FOREIGN PATENT DOCUMENTS

0401316B1 12/1990 (EP) .
05075784A 3/1993 (EP) .
WO9003015A 3/1990 (WO) .
WO9302402A 2/1993 (WO) .

OTHER PUBLICATIONS

Patent Abstracts of Japan, vol. 096, No. 010, Oct. 31, 1996 & JP 08 164631 A (Ricoh Co Ltd.) Jun. 25, 1996.
Patent Abstracts of Japan, vol. 012, No. 080 (E–590), Mar. 12, 1988 & JP 62 219752 A (Panafacom Ltd.) Sep. 28, 1987.

* cited by examiner

*Primary Examiner*—N. Le
*Assistant Examiner*—Lamson D. Nguyen

(57) ABSTRACT

A scanning device formed by a linear LED array mounted on an elongate holder, and a lens array. The holder is contained in end blocks which extend at right angles to the arrays to outside the holder. An adjustment rod is mounted between the projecting parts of the end blocks and through the agency of a compression spring exerts a bending moment on the holder in order to compensate for sagging of the arrays.

10 Claims, 3 Drawing Sheets

SCANNING DEVICE FOR SCANNING AN IMAGE CARRIER

BACKGROUND OF THE INVENTION

The present invention relates to a scanning device for scanning an image carrier, comprising a linear array of scanning elements, a holder for the array, which extends in the longitudinal direction of the array, and positioning means to maintain the scanning elements at a predetermined position from the image carrier. A scanning device of this kind is known from European Patent 0 401 316, which describes a scanning device for forming an image on a photoconductive image carrier by means of a linear array of co-operating LEDs and lenses. In this device the lens array focuses the light emitted by the array of LEDs into the plane in which the image carrier moves. In order to keep the linear array in the required position with respect to the imaging plane occupied by the image carrier, the arrays of LEDs and lenses in this known scanning device are fixed on a holder made from relatively thick metal and provided with stiffening ribs in order to keep the linear array in a predetermined focusing position throughout with respect to the image carrier.

Since in order to form an uninterrupted image the linear array holder can bear against the image carrier only outside its operative zone, the array is sensitive to sagging or deflection, and particularly in the case of a long linear array in large-format scanning devices in which the linear array is disposed beneath or above the imaging plane. This manifests itself in the form of locally non-sharp imaging.

SUMMARY OF THE INVENTION

The object of the present invention is to provide a scanning device of the type referred to in the preamble, wherein a linear imaging array can be maintained in a predetermined position with respect to the image carrier without the array having to be made in an extremely stiff construction.

To this end, according to the present invention, positioning means are formed by projections on the holder for the array, which projections extend substantially perpendicular to the array and parallel to one another, and an adjustment means which acts on the projections is provided to adjust the distance between the projections. As a result, the imaging array can, with simple means, be so adjusted that optimum focusing can be set at every part of the linear array, thus compensating for any array sag.

In one advantageous embodiment of the scanning device according to the present invention, the adjustment means comprises a pressure element which exerts on two spaced-apart projections, forces directed away from one another and operative in the longitudinal direction of the array. As a result, a linear array with the projections directed upwardly, which array sags in the middle due to its weight, is pressed straight.

Preferably, the pressure element comprises a first compression spring which presses against one side of a projection which is directed towards the other projection in order to press the two projections apart. As a result, a construction is obtained in which the spring force of the compression spring determines the force with which the linear array is pressed straight.

Further, preferably, the first compression spring is provided with first tensioning means which give the first compression spring an adjustable prestressing. As a result a very sensitive control is obtained for straightening the linear array, for example to compensate for other initial deviations in the straightness of the linear array.

In another embodiment of the scanning device according to the present invention, the adjustment means comprises a tension element which exerts on two spaced-apart projections, forces which are directed towards one another and which act in the longitudinal direction of the array. As a result, the sagging of a linear array disposed beneath the image carrier can be readily compensated. Another effect is that in the case of a linear array disposed above the image carrier and initially having an upwardly deflected form, straightening can be obtained in a simple manner.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
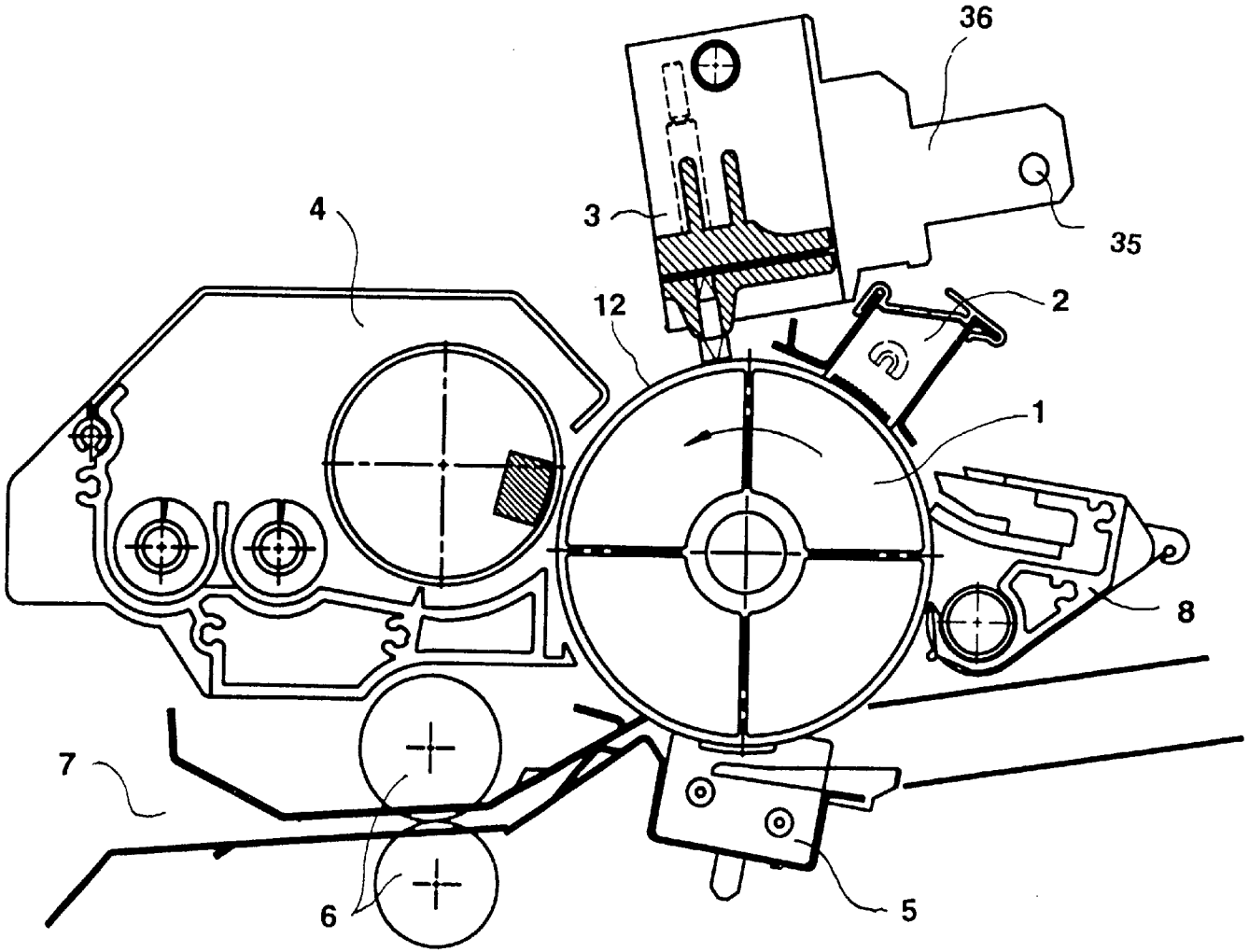
FIG. 1 is a cross-section of a printing apparatus in which a scanning device according to the present invention is disposed in the form of a printhead.

The printing apparatus shown in FIG. 1 is provided with an image carrier in the form of a photoconductive drum 1 which is rotated at a uniform speed by drive means (not shown) in the direction of the arrow.

The photoconductive surface of the drum 1 is electrostatically charged by means of a charging device 2 disposed above the photoconductive drum 1. A scanning device 3 in the form of an LED exposure array disposed next to the charging device 2 above the photoconductive drum 1 discharges the charged drum 1 image-wise in zones corresponding to the image to be formed and printed.

A scanning device 3 of this type which exposes in accordance with (black) image portions is generally referred to as a black writer. The LED exposure array 3 will be described in detail hereinafter.

A developing device 4 disposed next to the photoconductive drum 1 functions as a reverse developing device for covering the exposed areas of the photoconductor with a toner. A corona transfer device 5 disposed beneath the photoconductive drum 1 transfers the formed toner image to a receiving sheet fed along a sheet transport path 7 by a pair of transport rollers 6. The toner image printed on the receiving sheet is then fused on the receiving sheet in a fixing device (not shown).

After the transfer of the toner image any remaining toner is removed from the photoconductive drum 1 in a cleaning device 8, whereafter the photoconductive drum can be re-charged for the printing of a subsequent image.

The scanning device 3 shown in detail in FIGS. 2 to 5 comprises a linear LED array 10 and a Selfoc lens array 11 disposed at a specific distance from the LED array to focus the light emitted by the LEDs on to a narrow strip of the surface 12 of the photoconductive drum 1. The LED array 10 is mounted on a baseplate 13 fixed on an extruded aluminium profile 14 provided with fins 15 which provide some rigidity for the profile and can also provide cooling for the scanning device. The Selfoc lens array 11 is contained in a slot 16 formed in an extruded profile 17 fixed on the baseplate 13. Thus the extruded profiles 14 to 17 together with the baseplate 13 form a rigid unit for the LED array therebetween.

Figure 3:
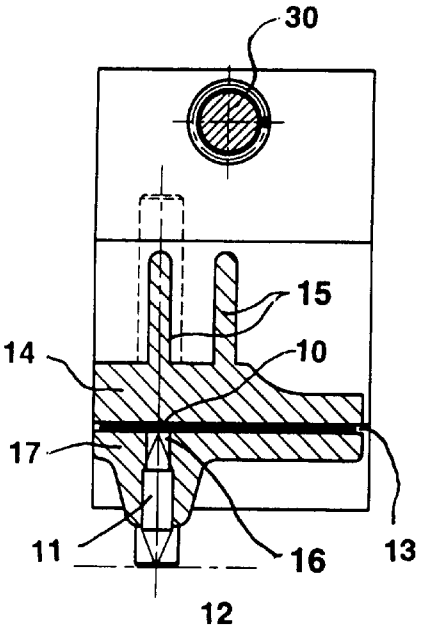
FIG. 3 is a section taken along line III—III of FIG. 2.
Figure 2:
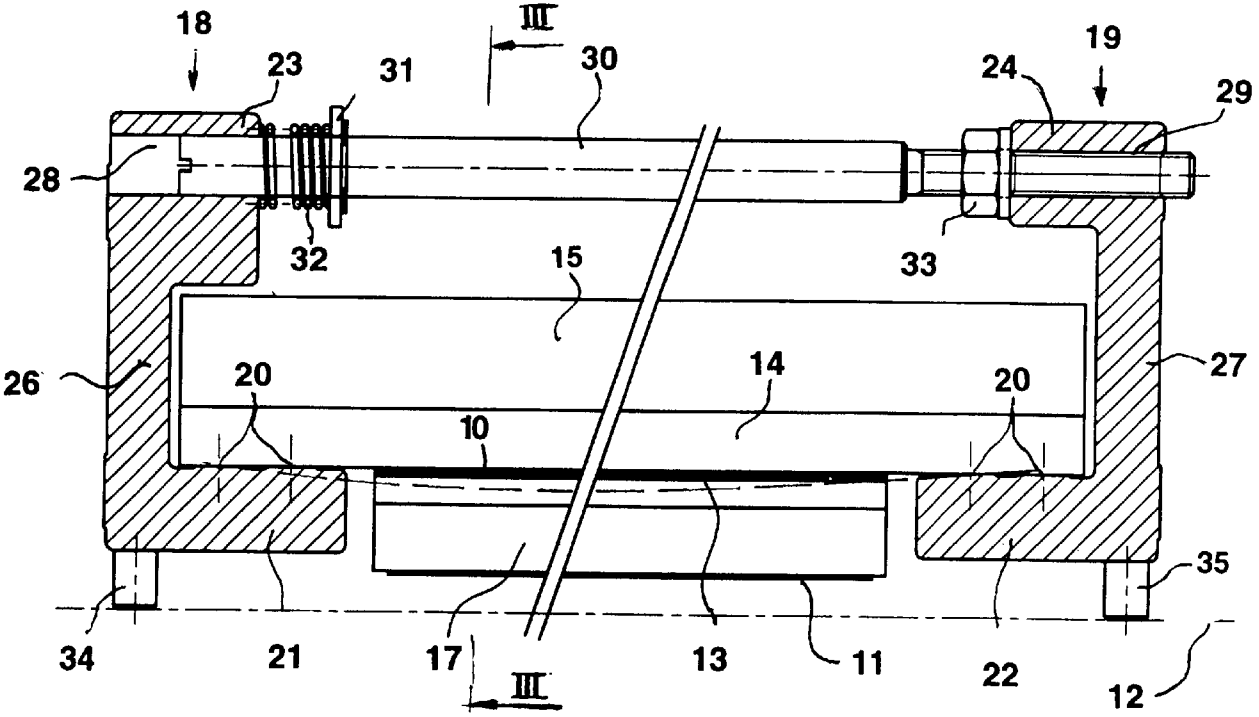
FIG. 2 is a side elevation in detail of the printhead of FIG. 1.

As clearly shown in FIG. 3 the Selfoc lens array 11 focuses the light emitted by the LEDs 10 onto the surface 12 of the photoconductive drum 1. On imagewise selective triggering of the LEDs the Selfoc lens array projects a corresponding image on to the photoconductive drum 1, which image delivers a print on to a receiving sheet in the manner indicated in the description of FIG. 1. As clearly shown in FIG. 2, the extruded profile 14 projects on either side from the extruded profile 17. U-shaped end blocks 18 and 19 are fixed on the projecting parts of the extruded profile 17, e.g. by means of screws, at the locations indicated by references 20. The limbs 21 and 22 of each U-shaped end block 18 and 19 and other the limbs 23 and 24 of each of the end blocks 18 and 19 extend parallel to the limbs 21 and 22 at a greater distance from the image plane 12 of the lens array. Thus the connecting members between the limbs 21, 23 and 22, 24 form projections 26 and 27 on the holder for the linear arrays of scanning elements 10 and 11, which extend substantially perpendicularly to the array and parallel to one another.

The limbs 23 and 24 of the end blocks are provided with round holes 28 and 29, the center-lines of which are situated in extension of one another and parallel to the linear LED array. The hole 29 in one of the end blocks (24) is provided with a screwthread. A pin 30 having the length of the linear arrays is provided at one end with a screwthread which fits in the screwthread in hole 29. The other end of the pin 30 is smooth and fits slidingly in hole 28. The head of the smooth end of the pin 30 is provided with a slot to enable pin 30 to be screwed further in or out of the screw hole 29 by means of a screwdriver.

The pin 30 is also provided with a collar 31 near the smooth end of the pin 30. A compression spring 32 is fitted between this collar 31 and the end block 18. On axial displacement of the pin 30 with respect to the end blocks 18 and 19 by means of a screwdriver the compression spring 32 is tensioned to a greater or lesser extent, so that it tends to press the limbs 23 and 24 apart by a variable force on the end blocks 18 and 19, thus exerting a variable bending moment on the linear array 10 and 11. The end blocks 18 and 19 are provided with adjustable supports 34 and 35 which bear against the photoconductive drum 1 in order to always hold the ends of the linear array at a distance from the photoconductive drum 1 such that a sharp image is obtained at the ends.

For the adjustment of the scanning device, the latter is placed in an optical measuring bench in the same position as the scanning device occupies in the printing apparatus. After adjustment of the scanning device by means of the adjustable supports, in order to obtain optimum image quality at the ends, the image quality in the middle of the linear array is measured. Any sagging of the linear array under the influence of gravity (indicated by a broken line in FIG. 2) results in a measurable unsharpness of the image. This deviation can be compensated by turning the pin 30. With the increasing force of the compression spring 32, the bending moment exerted on the linear array results in its displacement thereof in the upward direction. The turning of the pin 30 is stopped when a sharp imaging is also measured in the middle of the array. The pin 30 is locked in this position by means of a nut 33. Of course, it is possible to dispense with a screwthread connection between the pin 30 and the hole 29 and to obtain axial displacement of the pin 30 simply by turning the nut 33.

A sag of about 200 mm is not unusual, particularly in the case of a printing apparatus for wide formats in which the linear array may have a length of about 1 meter. With the construction according to the present invention this sag can be readily compensated for without excessively heavy construction being required.

Figure 5:
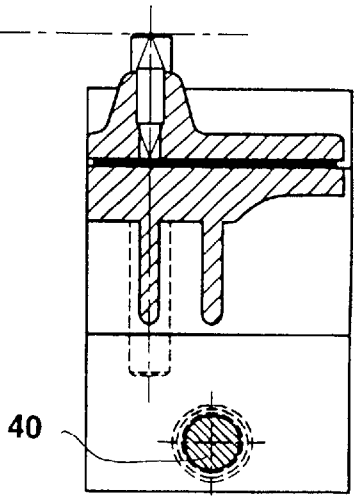
FIG. 5 is a cross-section taken along line V—V of FIG. 4.
Figure 4:
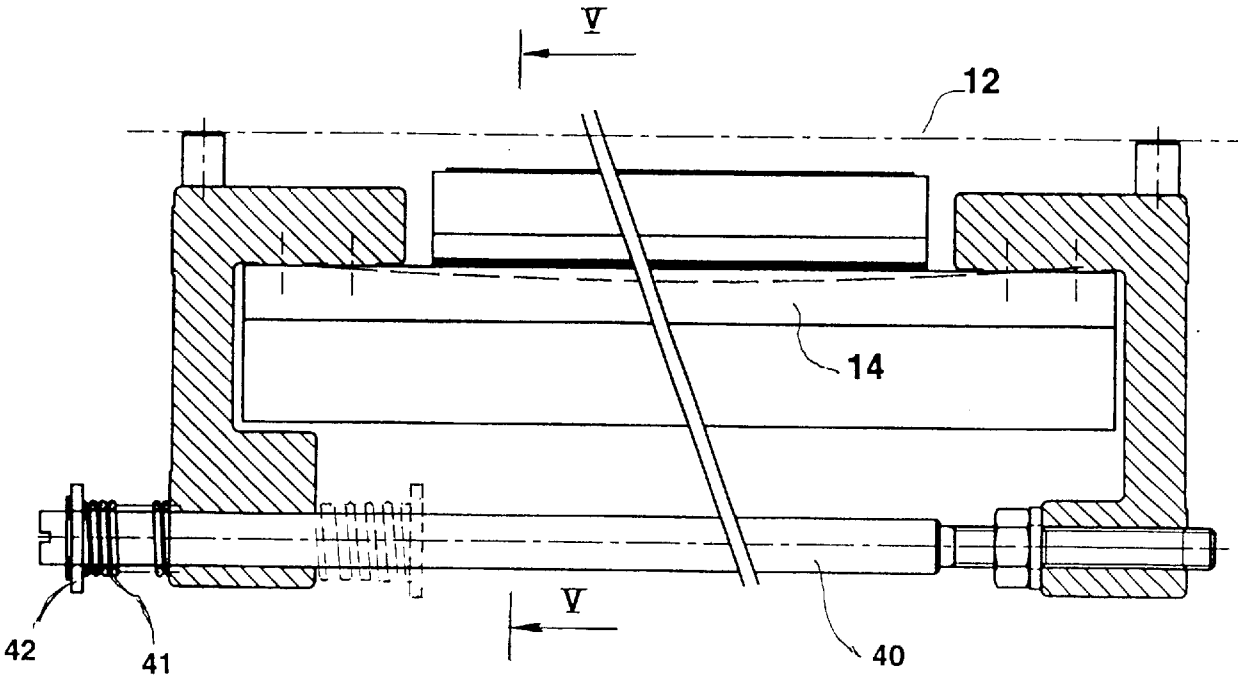
FIG. 4 is a side elevation of another printhead according to the present invention.

FIGS. 4 and 5 show a scanning device according to the present invention for use in a printing apparatus in which the scanning device is disposed underneath the photoconductive drum. This scanning device differs from the scanning device 3 shown in FIGS. 2 and 3 in that instead of pin 30, a longer pin 40 is used which projects beyond end block 18. A collar 41 is fixed on this projecting end and a compression spring 42 is disposed between the collar 41 and the outside of the end block 18.

Sagging of the holder 14 for the linear arrays (indicated by a broken line in FIG. 4) is compensated by turning the pin 40 in order to give the compression spring 42 a greater tensioning force so that the middle of the linear array can be moved upwards. As shown in broken lines in FIGS. 4 and 5, the collar 41 and compression spring 42 can also be disposed on pin 40. As a result, a linear array can also be adjusted in order to compensate for other forms of non-linearity, such as a curvature of the extruded profiles 14 in opposition to and greater than the curvature that the holder for the linear array in the printing device experiences as a result of sagging due to its weight.

The use of compression springs between the holder and compression rod (pin 30 or 40) to compensate for sagging of the LED array holder has the advantage over a compression rod acting directly on the holder projections, e.g. by a right-hand and left-hand screwthread at the ends of the compression rod, that the compression rod must make a larger angular rotation for a specific sag correction, and can therefore be adjusted much more sensitively.

As shown in FIG. 1, the scanning device 3 is mounted in pivoting arms 36 which are adapted to hinge about axis 35. Thus the scanning device 3 can be swung away for maintenance without losing the setting executed to compensate for the sag.

The scanning device according to the present invention can also be used for strip-wise scanning of an original with a lens array, for imaging on to a linear array of light-sensitive elements, e.g. CCDs, and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scanning device for scanning an image carrier, comprising:

a linear array of scanning elements, a holder for holding the array, said holder extending in the longitudinal direction of the array, positioning means for maintaining the scanning elements at a predetermined position from the image carrier, said positioning means comprising, projection means associated with the holder for the array, said projection means extending substantially perpendicular to the array and in spaced apart, opposing relationship relative to one another, and further including, an adjustment means which acts on the projection means to adjust the distance between the projection means.

2. The scanning device according to claim 1, wherein the adjustment means comprises a pressure element which exerts pressure on the two spaced-apart projections, forcing them away from one another and operative in the longitudinal direction of the array.

3. The scanning device according to claim 2, wherein the pressure element comprises a first compression spring which presses against one side of a projection which in turn is directed towards the other projection in order to press the two projections apart.

4. The scanning device according to claim 3, wherein the first compression spring is provided with first tensioning means which gives the first compression spring an adjustable prestressing.

5. The scanning device according to claim 1, wherein the adjustment means comprises a tension element which exerts forces on two spaced-apart projections which are directed towards one another and which act in the longitudinal direction of the array.

6. The scanning device according to claim 5, wherein the tension element comprises a second compression spring which presses against one side of a projection, directing it away from the other projection in order to press the two projections towards one another.

7. The scanning device according to claim 6, wherein the second compression spring is provided with second stressing means which give the second compression spring an adjustable prestressing.

8. The scanning device according to claim 1, wherein the projections extend on a side of the holder which is remote from the linear array.

9. The scanning device according to claim 1, wherein the projections are connected to the holder near the ends of the linear array.

10. A printing apparatus which includes, an image carrier, a charging device disposed above the image carrier for electrostatically charging the image carrier, a scanning device disposed next to the charging device and above the image carrier for discharging the charged drum image-wise in zones corresponding to the image to be formed and printed, a developing device disposed next to the image carrier for covering the exposed areas of the image carrier with a toner, a sheet transport path operatively associated with the charging device for introducing a receiving sheet thereto, and a corona transfer device disposed beneath the image carrier for transferring a formed toner image to the receiving sheet which is fed along the sheet transport path, wherein the scanning device comprises, a linear array of scanning elements, a holder for holding the array, said holder extending in the longitudinal direction of the array, positioning means for maintaining the scanning elements at a predetermined position from the image carrier, said positioning means comprising, projection means associated with the holder for the array, said projection means extending substantially perpendicular to the array and in spaced apart, opposing relationship relative to one another, and further including, an adjustment means which acts on the projection means to adjust the distance between the projection means.

* * * * *